US006666033B1

(12) United States Patent
Swift et al.

(10) Patent No.: US 6,666,033 B1
(45) Date of Patent: Dec. 23, 2003

(54) METHOD AND APPARATUS FOR FINE TUNING AN ORIFICE PULSE TUBE REFRIGERATOR

(75) Inventors: Gregory W. Swift, Santa Fe, NM (US); John J. Wollan, Denver, CO (US)

(73) Assignee: The Regents of the University of California, Los Alamos, CA (US)

( * ) Notice: Subject to any disclaimer, the term of this patent is extended or adjusted under 35 U.S.C. 154(b) by 0 days.

(21) Appl. No.: 10/163,781

(22) Filed: Jun. 6, 2002

(51) Int. Cl.[7] ..... F25B 9/00
(52) U.S. Cl. ..... 62/6
(58) Field of Search ..... 62/6

(56) References Cited

U.S. PATENT DOCUMENTS 5,720,172 A * 2/1998 Ishizaki ..... 62/6
6,021,643 A * 2/2000 Swift et al. ..... 62/6
6,351,954 B1 * 3/2002 Nogawa et al. ..... 62/6
6,374,617 B1 * 4/2002 Bonaquist et al. ..... 62/6
6,477,847 B1 * 11/2002 Bonaquist et al. ..... 62/99

* cited by examiner

*Primary Examiner*—William C. Doerrler
(74) *Attorney, Agent, or Firm*—Ray G. Wilson

(57) ABSTRACT

An orifice pulse tube refrigerator uses flow resistance, compliance, and inertance components connected to a pulse tube for establishing a phase relationship between oscillating pressure and oscillating velocity in the pulse tube. A temperature regulating system heats or cools a working gas in at least one of the flow resistance and inertance components. A temperature control system is connected to the temperature regulating system for controlling the temperature of the working gas in the at least one of the flow resistance and inertance components and maintains a control temperature that is indicative of a desired temporal phase relationship.

12 Claims, 6 Drawing Sheets

METHOD AND APPARATUS FOR FINE TUNING AN ORIFICE PULSE TUBE REFRIGERATOR

STATEMENT FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to orifice pulse tube refrigerators, and, more particularly, to orifice pulse tube refrigerators with reduced Rayleigh streaming in the pulse tube.

BACKGROUND OF THE INVENTION

Orifice pulse tube refrigeration is the most rapidly developing field of cryogenic refrigeration today. The high efficiency of a Stirling-based thermodynamic cycle, the lack of moving parts at cryogenic temperature, and the lack of small, easily plugged orifices at cryogenic temperature combine to make this new technology inexpensive and reliable. Furthermore, orifice pulse tube refrigerators can be driven by thermoacoustic heat engines, creating for the first time cryogenic refrigeration with no moving parts. Background information about orifice pulse tube refrigerators is given, for example, by R. Radebaugh, "A review of pulse tube refrigeration," pages 1191–1205 in Adv. Cryogenic Eng., Volume 35 (1990), and in R. Radebaugh, "Advances in Cryocoolers," 1997, pages 33–44 in the Proceedings of the Sixteenth International Cryogenic Engineering Conference/international Cryogenic Materials Conference (ICEC16/ICMC), edited by T. Haruyama et al., (Elsevier, Oxford, 1997), all incorporated herein by reference.

A prior art orifice pulse tube refrigerator is shown schematically in FIG. 1A. One of the key parameters in an operational orifice pulse tube refrigerator is the temporal phase difference between oscillating pressure and oscillating velocity. The reference convention used herein is that x is the distance from the driver along the axis of the refrigerator, that positive velocity is velocity in the positive x direction, and that θ is the temporal phase angle by which oscillating pressure leads oscillating velocity. This temporal phase θ is also called the phase of the complex acoustic impedance Z. It is well known that θ is a function of x, due for example, to the compressibility of the gas in various portions of the refrigerator.

Relative magnitudes and phases are conventionally displayed in a phasor diagram, such as shown in FIG. 1B. FIG. 1B illustrates, for example, the viscous pressure drop across regenerator 12, which manifests itself as the difference between the pressure phasor $P_{1,driver}$ at driver 10 and the pressure phasor $P_{1,pulse}$ tube in pulse tube 18. The difference between the volume flow rate phasor $U_{1,ambient\ heat\ exchanger}$ at ambient heat exchanger 28 and the volume flow rate phasor $U_{1,cold}$ at cold heat exchanger 26 is due to the compressibility of the gas in pulse tube 18. In FIG. 1B, $P_{1,ambient\ heat\ exchanger}$ can be assumed nearly identical to $P_{1,pulse\ tube}$, SO $\theta_{ambient\ heat\ exchanger}$ is the angle by which $P_{1,pulse\ tube}$ leads $U_{1,ambient\ heat\ exchanger}$, which is approximately 50 degrees in FIG. 1B. This is a typical value for an orifice pulse tube refrigerator with an inertial impedance ("inertance").

Continuing to refer to FIGS. 1A and 1B, it is well known that the entire phase distribution θ(x) throughout an orifice pulse tube refrigerator, and, in particular, in regenerator 12, can be controlled by means of inertance 14 and flow resistances 16, 24 in an acoustic impedance network atop pulse tube 18 of the orifice pulse tube refrigerator. An early published reference to this use of inertance was by S. W. Zhu et al., "Phase shift effect of the long neck tube for the pulse tube refrigerator," in the Proceedings of Cryocoolers 9, held June 1996 in New Hampshire. An adjustable version of such an acoustic impedance network with inertance is described by D. L. Gardner et al., "Use of inertance in orifice pulse tube refrigerators," Cryogenics, Volume 37, pages 117–121 (1997) and G. W. Swift et al., "Pulse Tube Refrigerator With Variable Phase Shift," U.S. Pat. No. 6,021,643, Feb. 8, 2000, all incorporated herein by reference. In the '643 patent, a variable acoustic impedance network, as shown atop pulse tube 18 in FIG. 1A, is described, comprising an inertance tube 14, a compliance volume 22, and two adjustable flow resistance valves 16,24.

FIG. 2, which is a reproduction of FIG. 7 from the '643 patent, shows the broad range of $\theta_{ambient\ heat\ exchanger}$ accessible by this method. The points on FIG. 2 show some typical values of acoustic impedance Z at the top of the pulse tube, experimentally accessed by adjusting the two valves 16, 24; all points between these points are also accessible. Absent viscous effects in inertance 14, all values of Z between the two horizontal dashed lines would be accessible, and the experimental reality is not far from that ideal. The values of θ represented by these points range from about zero to 80 degrees (the angle between the horizontal axis and a line from the origin to a given point).

The three large circles on FIG. 2 are contours of constant power dissipation in the acoustic impedance network 14, 16, 22, 24, and, hence, of constant gross cooling power at cold heat exchanger 26. Then, an operating point for the orifice pulse tube refrigerator is uniquely defined by, and is often chosen by, selecting a gross cooling power, i.e., at which circle one wants to operate, and a value of θ. The actual net refrigerating power is the gross cooling power minus the sum of heat leaks to cold heat exchanger 26. Imperfect operation of regenerator 12 and imperfect operation of pulse tube 18 are two sources of potentially large heat leaks, but proper design can minimize these. Efficient refrigeration also requires little viscous dissipation in regenerator 12.

It is well known that refrigeration occurs only if θ lies between plus 90 degrees and minus 90 degrees in regenerator 12, and that both regenerator heat leak and viscous dissipation are minimized by keeping θ as close to zero degrees as possible throughout regenerator 12. In a cryogenic orifice pulse tube refrigerator, typically θ is between zero and minus 45 degrees at the ambient end of the regenerator, passes through zero somewhere within the regenerator, and is positive and less than 45 degrees at the cold end of the regenerator. However, the sensitivity of regenerator efficiency to the exact values of θ(x) is not too strong, and a regenerator with θ(x) shifted by 10 or even 20 degrees from the optimal values may not have a noticeable loss in efficiency with respect to either viscous dissipation or heat leak.

The temporal phase θ also plays an important role in the efficiency of the pulse tube of the orifice pulse tube refrigerator. Pulse tubes are susceptible to an internal, toroidal steady convection, called Rayleigh streaming, that is superimposed upon the desired oscillatory motion. Rayleigh streaming reduces the efficiency of orifice pulse tube refrigerators because the streaming convects heat from ambient heat exchanger 28 atop pulse tube 18 to cold heat exchanger 26 at the bottom of pulse tube 18, thereby reducing the cooling power of the orifice pulse tube refrigerator. Rayleigh streaming is caused by boundary-layer processes at the side walls of the pulse tube, which are controlled by various parameters including phase angle θ, the taper angle of the pulse tube, and properties of the working gas, as described by J. R. Olson et al., "Acoustic streaming in pulse tube refrigerators: Tapered pulse tubes," Cryogenics, Volume 37, pages 769–776 (1997) and G. W. Swift et al., "Tapered pulse tube for pulse tube refrigerators," U.S. Pat. No. 5,953,920, Sep. 21, 1999, all incorporated herein by reference. All other variables being fixed, there is at most one value of θ that stops Rayleigh streaming.

Rayleigh streaming is extremely sensitive to the value of θ, as shown in FIG. 3, from G. W. Swift et al., "Performance of a tapered pulse tube," pages 315–320 in Cryocoolers 10, edited by R. G. Ross Jr. (Kluwer Academic/Plenum Publishers, 1999), incorporated herein by reference. This experimental evidence shows that a 3 degree change in θ away from the optimum value can cause enough Rayleigh streaming to consume 10% of the gross cooling power of the orifice pulse tube refrigerator. A 3 degree change in θ is small enough that it would have no significant effect on the regenerator efficiency.

The temporal phase θ can be adjusted, as described in the '643 patent, but there is no need for such a large range of adjustability when nominally identical orifice pulse tube refrigerators are mass produced for nominally identical applications. In such a circumstance, an acoustic impedance network with geometrically fixed components would be much cheaper than the high-pressure bellows-sealed valves described in Swift et al., supra. For automated control, expensive high-torque valve actuators may also be needed to adjust the resistances automatically. However, it is often necessary to provide fine-tuning adjustment of the acoustic impedance network, because of the sensitivity of Rayleigh streaming to the conditions of operation. Even nominally identical orifice pulse tube refrigerators that are mass produced for nominally identical applications may suffer from minor unit-to-unit construction variations or from diurnal and seasonal variations in ambient temperature.

Hence, it is desirable to provide fine-tuning adjustments to the value of θ in the pulse tubes of orifice pulse tube refrigerators. It is further desirable to provide for the fine-tuning adjustments with inexpensive hardware.

Various advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention includes an orifice pulse tube refrigerator having flow resistance, compliance, and inertance components connected to a pulse tube for establishing a phase relationship between oscillating pressure and oscillating velocity in the pulse tube. A temperature regulating system heats or cools a working gas in at least one of the flow resistance and inertance components. A temperature control system is connected to the temperature regulating system for controlling the temperature of the working gas in the at least one of the flow resistance and inertance components and maintains a control temperature that is indicative of a desired temporal phase relationship.

BRIEF DESCRIPTION OF THE DRAWINGS

The accompanying drawings, which are incorporated in and form a part of the specification, illustrate the present invention and, together with the description, serve to explain the principles of the invention. In the drawings.

DETAILED DESCRIPTION

Figure 1B:
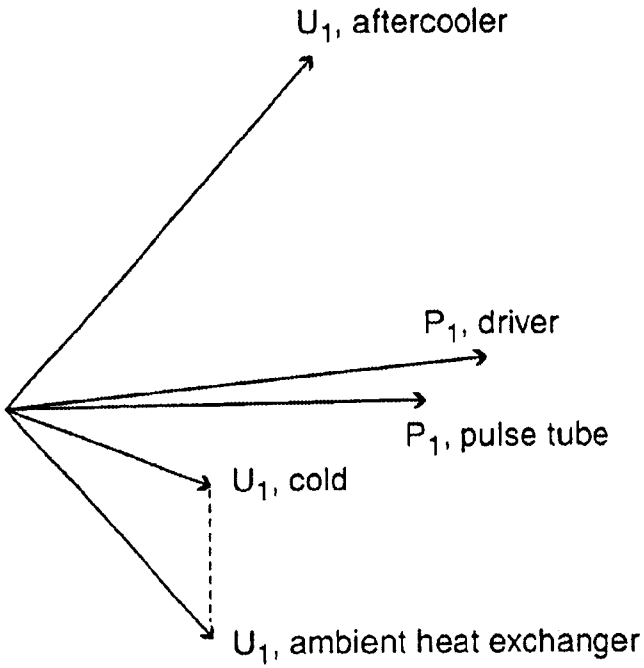
Fig. 1B Prior Art
FIGS. 1A and 1B schematically depict a prior art orifice pulse tube refrigerator having an inertance and a phasor diagram of the phase relationships in the refrigerator.
Figure 1A:
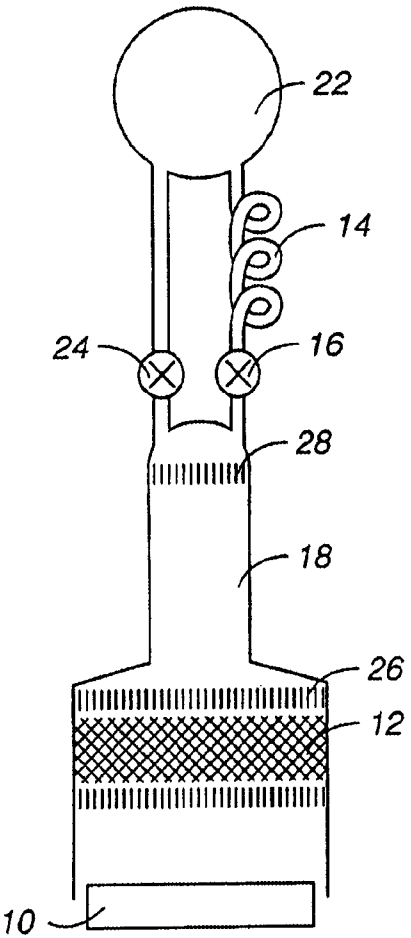
Fig. 1A Prior Art
Figure 4:
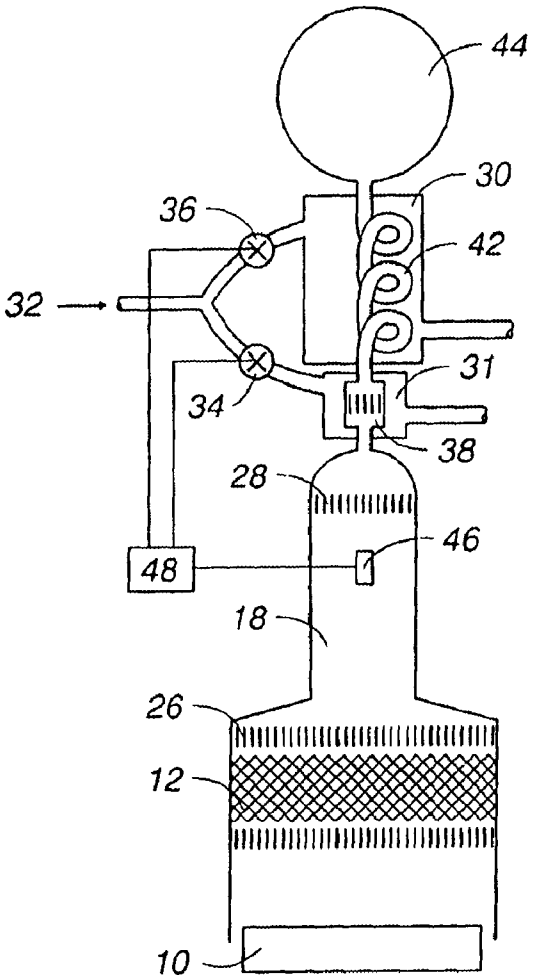
FIG. 4 schematically depicts an orifice pulse tube refrigerator with an exemplary system for fine tuning the phase θ according to the present invention.

In accordance with an exemplary embodiment of the present invention, as shown in FIG. 4, some or all of the elements of the acoustic impedance network atop pulse tube 18 can be enclosed with temperature control jackets 30, 31 that, e.g., contain a flowing fluid 32, whose flow rate can be controlled, e.g., by valves 34, 36. In this exemplary embodiment, the fluid flow rate controls the temperature of those elements and provides fine control for the resulting phase angle θ between oscillating pressure and oscillating flow rate. The basic pulse tube refrigerator elements having the same function as elements shown in FIG. 1A have like numbers.

Figure 2:
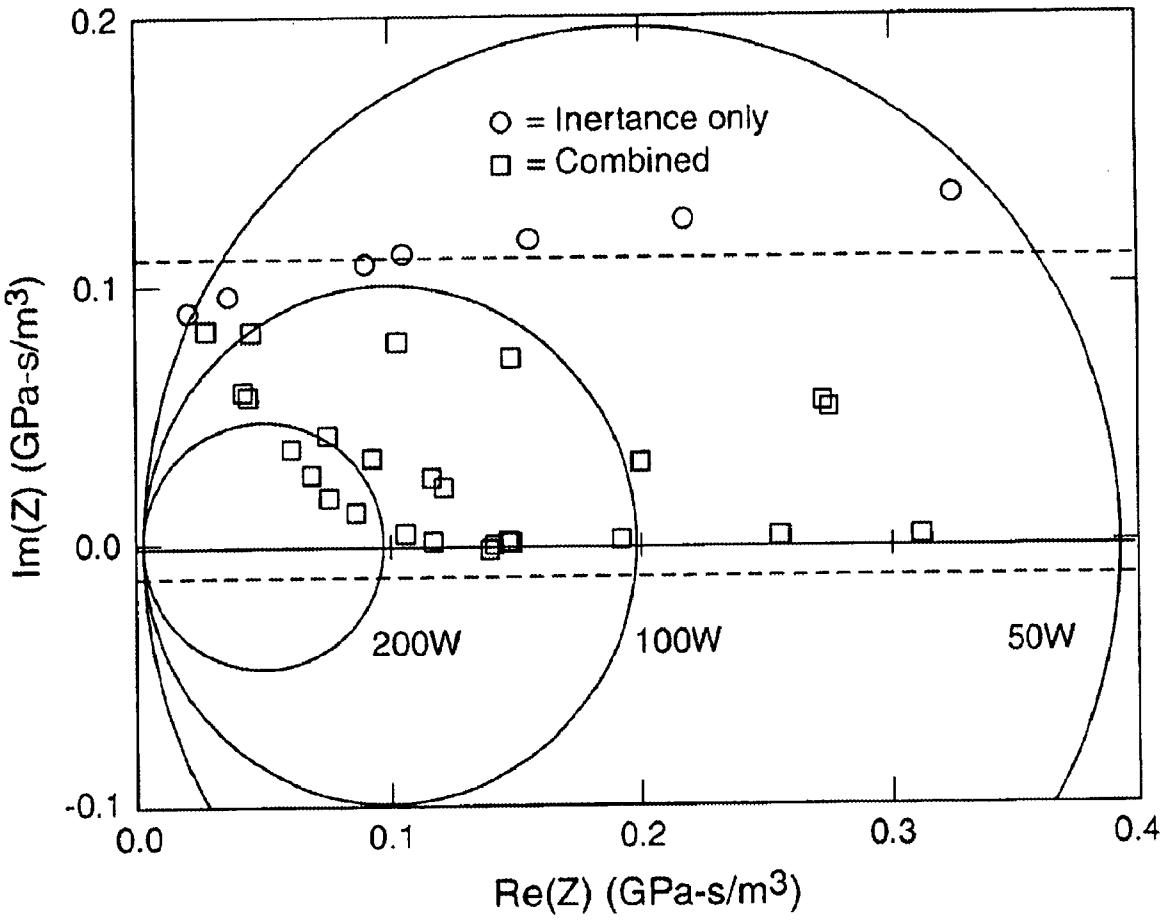
Fig. 2 Prior Art
FIG. 2 graphically depicts the broad range of impedance Z and phase θ values atop the pulse tube that can be obtained by adjusting resistive valves in a typical acoustic impedance network.
Figure 3:
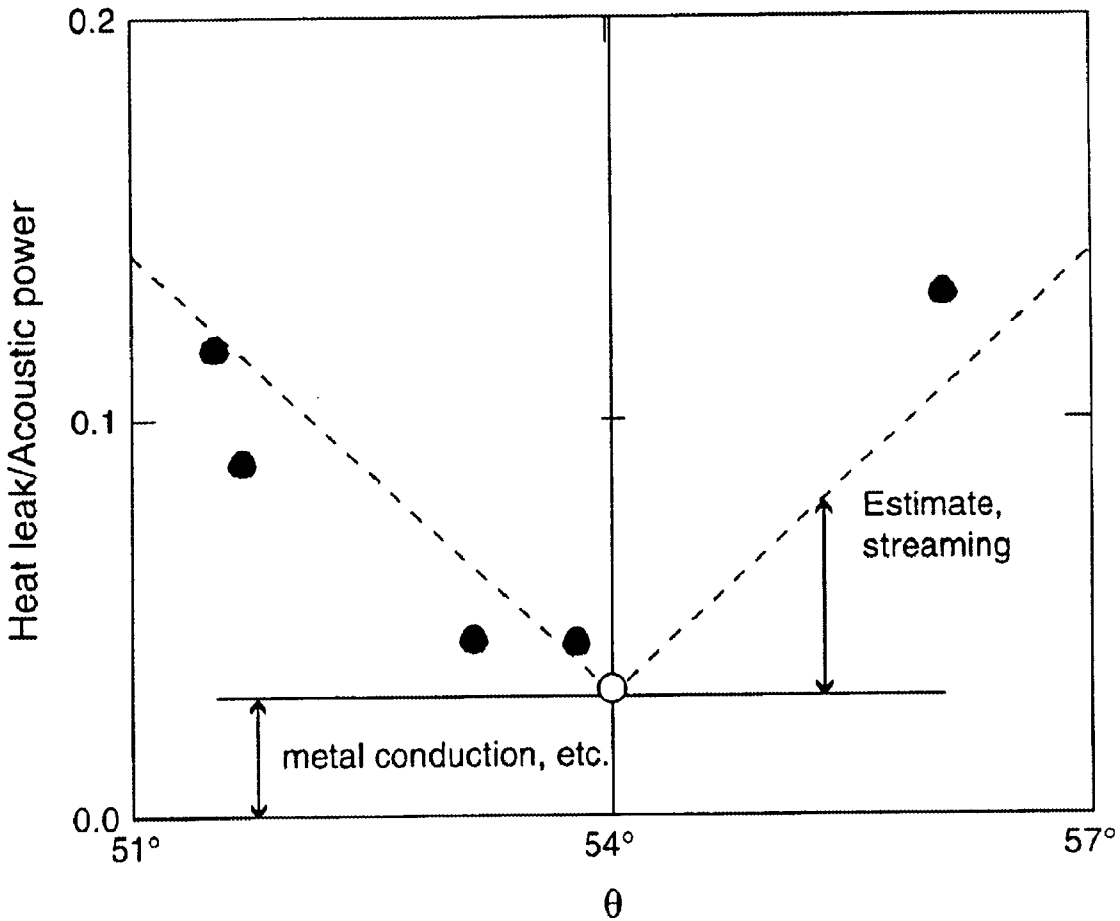
Fig. 3 Prior Art
FIG. 3 graphically depicts the heat leak in one pulse tube as a function of phase θ.

The inertial impedance of an inertance tube is equal to the product of the gas density times the cross sectional area divided by the length of the tube, and the gas density is proportional to the absolute temperature. Thus, the temperature of the working gas provides a significant control of inertance 42, which contributes to the imaginary part of Z—the vertical axis in FIG. 2. The resistive impedance of a resistive valve, fixed orifice, flow impedance, or other flow resistance 38 depends on the viscosity of the gas, which, in turn, is typically proportional to the 0.7 power of the absolute temperature. Again, the temperature of the working gas provides a significant control of the resistive impedance, which contributes to the real part of Z—the horizontal axis in FIG. 2. The compliance of compliance tank 44 is independent of temperature. The temperatures of the working gas in these components is determined by a balance among dissipation of acoustic power into heat within these components; thermoacoustic transport of heat through the working gas to or from these components, from or to adjacent components; and the temperatures of the solid surfaces of the components. Hence, the present invention provides for varying flow resistance and/or inertance of the acoustic impedance network by varying the temperature of the working gas in at least one of these components in an orifice pulse tube refrigerator.

All orifice pulse tube refrigerators reject waste heat to ambient temperature, usually to a flowing stream of ambient water or ambient air. Either of these two fluids can be used in temperature control jackets 30, 31. The control of the flow rate of external temperature control fluid 32 by means of valves 34, 36 is much less expensive than the control of a variable valve in the orifice pulse tube refrigerator acoustic impedance network because the external air or water is typically at or near ambient pressure, so operating torques are small and sealing challenges are minor. In addition, fluids leaking from an external system are readily replaced.

If the orifice pulse tube refrigerator is driven by a combustion-powered thermoacoustic engine, flue gas could be used as the fluid 32 whose flow through jackets 30, 31 is controlled, thereby providing variable warming of the resistive 38 and inertial 42 elements instead of the variable cooling provided by ambient air or water described in the previous paragraph.

Figure 5A:
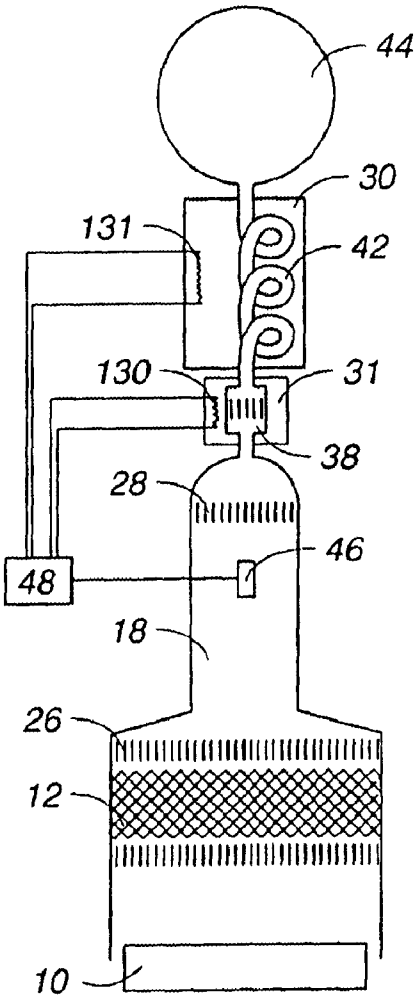
FIGS. 5A and 5B schematically depict orifice pulse tube refrigerators with two other systems for fine tuning the phase θ according to the present invention.
Figure 5B:
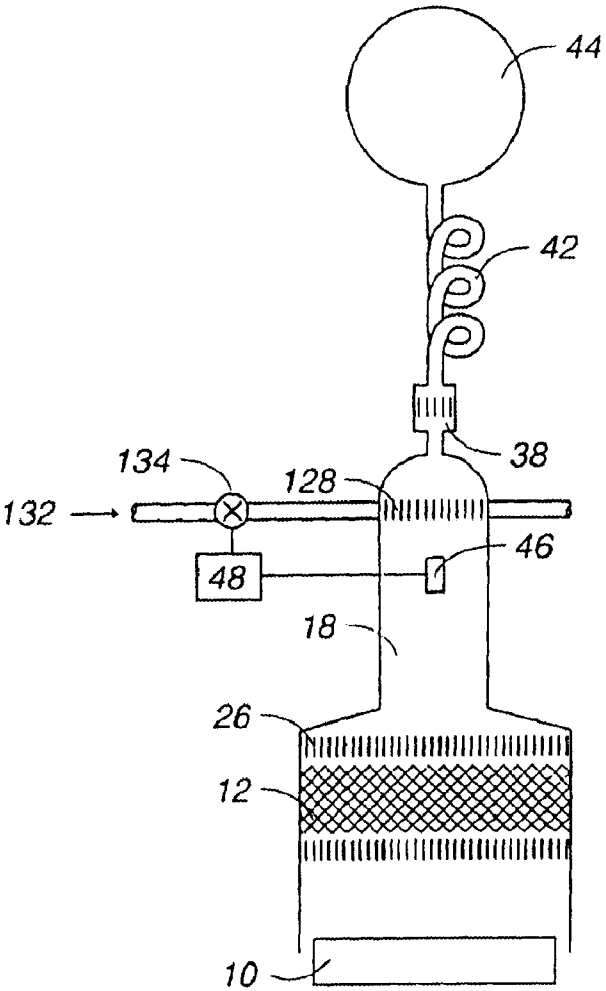

Alternatively, as shown in FIG. 5A, heaters 130, 131 can be used in temperature control jackets 30, 31 to control the temperatures of resistive 38 and inertial 42 components. Heaters 130, 131 may be electric resistance heaters or combustion heaters. Another alternative, shown in FIG. 5B, is to control valve 134 to adjust fluid flow 132 to thereby regulate the temperature of ambient heat exchanger 128 atop the pulse tube. This alternative relies on the thermoacoustic thermal connection in the working gas between ambient heat exchanger 128 and resistive 38 and inertial 42 components to control the temperatures of resistive 38 and inertial 42 components. Elements in FIG. 5 having the same function as elements shown in FIG. 4 have like numbers.

A temperature sensor 46 in or on the side wall of pulse tube 18, or in the gas inside of the side wall of pulse tube 18 is located to provide a control temperature of the working gas that is useful for maintaining a selected phase angle. An exemplary location of sensor 46 that is axially midway between the cold end and the ambient end of pulse tube 18 gives a very convenient measure of Rayleigh streaming in pulse tube 18. When sensor 46 at the mid-point location indicates a temperature nearly equal to the average of the ambient and cold temperatures, the Rayleigh streaming is nearly stopped. If the mid-point temperature is well above the average, the Rayleigh streaming is down along the side wall of pulse tube 18 and up in the center. If the mid-point temperature is well below the average of the ambient and cold temperatures, the Rayleigh streaming is up along the side wall of pulse tube 18 and down in the center.

For example, such a sensor is readily used to provide feedback through controller 48 for controlling valves 34, 36 and the concomitant fluid 32 flow rate through fluid jackets 30, 31 for the system shown in FIG. 4. Likewise, heaters 130, 131 are selectively energized for the system shown in FIG. 5A; flow control valve 134 is adjusted for the system shown in FIG. 5B.

While the mid-point temperature along pulse tube 18 provides generally a linear signal and is a preferred signal, other temperatures in the pulse tube refrigerator may be used. For example, the sensor might sense the temperature of cold heat exchanger 26 and output a control signal that maintains a cold output temperature. It should be noted that such other temperatures may be non-linear and provide a more difficult control signal.

Temperature control of the operating gas may also provide fine tuning for Rayleigh streaming suppression in the thermal buffer column in a pistonless Stirling device, as described in U.S. Pat. No. 6,032,464 "Traveling Wave Device with Mass Flux Suppression" (Swift et al.), incorporated herein by reference.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An orifice pulse tube refrigerator having flow resistance, compliance, and inertance components connected to a pulse tube for establishing a phase relationship between oscillating pressure and oscillating velocity in the pulse tube, the improvement comprising:

a temperature regulating system for heating or cooling a working gas in at least one of the flow resistance and inertance components; and a temperature control system connected to the temperature regulating system for controlling the temperature of the working gas in the at least one of the flow resistance and inertance components and adapted to maintain a control temperature that is indicative of a desired temporal phase relationship between oscillating pressure and oscillating velocity of the working gas.

2. The orifice pulse tube refrigerator according to claim 1, further including a temperature sensor located to establish the control temperature.

3. The orifice pulse tube refrigerator according to claim 2, wherein the temperature sensor is located to sense a temperature of the pulse tube midway between a cold end and an ambient end of the pulse tube.

4. The orifice pulse tube refrigerator according to claim 1, wherein the temperature regulating system further includes:

a temperature control jacket covering at least one of the flow resistance and inertance components; and a flow control system for adjusting the flow of cooling or heating fluid to the temperature control jacket.

5. The orifice pulse tube refrigerator according to claim 1, wherein the temperature regulating system further includes electrical resistance heating elements adjacent at least one of the flow resistance and inertance components.

6. The orifice pulse tube refrigerator according to claim 1, wherein the temperature regulating system further includes a flow control system for adjusting fluid flow to an ambient heat exchanger in the pulse tube to provide temperature adjustment of the working gas in the flow resistance and inertance components.

7. A method for controlling a phase relationship between oscillating pressure and oscillating velocity in a pulse tube of an orifice pulse tube refrigerator having flow resistance, compliance, and inertance components connected to the pulse tube comprising:

regulating the temperature of a working gas in at least one of the inertance or resistive components about a temperature that maintains a selected phase relationship.

8. The method of claim 7, wherein regulating the temperature of the working gas includes controlling the flow rate of a fluid through a temperature control jacket covering at least one of the inertance and flow resistance components.

9. The method of claim 7, wherein regulating the temperature of the working gas includes controlling the flow rate of a fluid through an ambient heat exchanger located between the pulse tube and the flow resistance, compliance, and inertance components to adjust the temperature of the working gas in at least one of the inertance and flow resistance components.

10. The method of claim 7, wherein regulating the temperature of the working gas includes controlling heating elements located adjacent at least one of the inertance and flow resistance components.

11. The method of claim 7, further including the step of sensing a control temperature of the pulse tube to output a control signal for regulating the temperature of the working gas.

12. The method of claim 11, wherein the control temperature is a temperature midway between a cold end and an ambient end of the pulse tube.

* * * * *